US005395122A

United States Patent [19]

Kraemer

[11] Patent Number: 5,395,122

[45] Date of Patent: Mar. 7, 1995

[54] GAME TARGET APPARATUS ASSEMBLY

[76] Inventor: Sandy F. Kraemer, 2402 Ceresa La., Colorado Springs, Colo. 80909

[21] Appl. No.: 86,209

[22] Filed: Jul. 6, 1993

[51] Int. Cl.[6] ..... A63B 61/36

[52] U.S. Cl. ..... 273/400; 273/407; 273/176 B; 273/181 A

[58] Field of Search ..... 273/176 B, 181 A, 181 R, 273/181 F, 400, 401, 176 AA, 176 AB

[56] References Cited

U.S. PATENT DOCUMENTS

| | | | |
|---|---|---|---|
| 1,208,235 | 12/1916 | Thayer | 273/400 |
| 1,392,662 | 10/1921 | Seibold | 273/400 |
| 1,419,554 | 6/1922 | Ganse | 273/400 |
| 3,195,898 | 7/1965 | Respini | 273/181 F |
| 3,348,846 | 10/1967 | Atchison | 273/181 A |
| 3,467,388 | 9/1969 | Weiler | 273/181 A |
| 3,540,734 | 11/1970 | Temple | 273/181 A |
| 3,929,334 | 12/1975 | Magazzu | 273/181 F |
| 4,145,048 | 3/1979 | Basil | 273/400 |
| 5,056,795 | 10/1991 | Buhrow | 273/400 |

*Primary Examiner*—Mark S. Graham
*Attorney, Agent, or Firm*—Phillip A. Rein

[57] ABSTRACT

A game target apparatus assembly utilizing a plurality of game target ring assemblies each having 1) a main target ring member; 2) a target net assembly secured to the main target ring member; and 3) a target ring support assembly secured to the main target ring member. The main target ring member is provided with a ring opening section having a support wall portion with a target opening and integral with an arrow shaped section having target sequence indicia thereon. The target net assembly can be an open end net assembly to allow a ball to pass through or a closed end net assembly to prevent the ball from falling therethrough. The target ring support assembly may be one of two embodiments being 1) a main ground anchor assembly; or 2) a detachable ground anchor assembly. Both embodiments include a handle impalement section or member which extends substantially laterally and being of arcuate shape from the support wall portion of the main target ring assembly. Each handle impalement member is operable to be ready to grasp by a game participant's fist for grasping and easy insertion into a game playing surface. The main ground anchor assembly includes a handle impalement section integral with a fluke spike section having an outer tapered end section. The fluke spike section is readily inserted into the game playing surface through the tapered end section. The detachable ground anchor assembly includes a target ring connector member integral with the main target ring member and adapted to be releasably inserted in the handle and impalement member.

1 Claim, 1 Drawing Sheet

GAME TARGET APPARATUS ASSEMBLY

PRIOR ART

A patent search on this invention revealed the following United States patents:

| U.S. Pat. No. | Invention | Inventor |
|---|---|---|
| 1,258,931 | GAME APPARATUS | Alfred W. Newcombe |
| 1,587,295 | WICKET GOLF GAME | Harry C. Gammeter |
| 1,715,365 | BRIDGE GOLF | Hoffman et al |
| 2,580,799 | REVOLVING TARGET | Charles E. Lauterbach |
| 3,467,388 | GOLF GAME AND PRACTICE DEVICE | Harry Weiler |
| 4,111,422 | LAWN GAME DEVICE WITH SWUNG LAUNCHING STICK | Michael J. Burcenski |
| 4,168,066 | GLIDING DISC PROJECTILE AND TARGET GAME | Sole et al |
| 4,323,251 | TARGET HOLDER | Loveland et al |
| 4,635,943 | INDOOR AND OUTDOOR GAME | Larry Lumpkin |
| 5,090,704 | GOLF GAME TARGET | Joseph C. Dona |

The Newcombe, Gammeter, and Hoffman et al patents disclose target members utilized in a game for throwing a ball therethrough.

The Lauterbach patent discloses a revolving target having a circular target plate attached to a pipe by plates.

The Weiler patent discloses a golf game and practice device.

The Burcenski patent discloses a lawn game device having a target with a circular ring attached to a support spike to be driven into the ground support surface.

The Sole et al patent discloses a target game utilizing a disc to be thrown through a combination of three target members mounted on a support stand.

The Loveland et al patent discloses a target holder having a spike member to be driven into the ground, a circular target attached to an upper end of the spike member, and a plurality of clips to hold a paper target on the circular target.

The Lumpkin patent discloses an flying disc and target combination which uses an oval target member adjustable about a support stand.

The Dona patent discloses a golf game target having 1) a support spike to be driven into a support ground surface; 2) a target member secured to an upper portion of the spike member; and 3) a golf hole indicia member attached to an uppermost portion of the circular target ring.

PREFERRED EMBODIMENT OF THE INVENTION

In one preferred embodiment of this invention, a game target apparatus assembly includes a plurality of game target ring assemblies which are arranged on a suitable playing surface in a method of game play. Each game target ring assembly is affixed to the playing surface by a target ring support assembly allowing one or more of the game target ring assemblies to be sequentially arranged forming a highly variable game. Ideally, a golf ball is struck by a golf club with the intention of passing the golf ball through a target opening in respective ones of the game target ring assemblies. Having done so, a competitor will then progress to another game target ring assembly to repeat the process of passing the golf ball through the target opening. The competitor using the least amount of golf club strokes to pass the golf ball through the openings in all of the game target ring assemblies will be declared the game winner.

The game target ring assembly includes three primary components being 1) a main target ring member; 2) a target net assembly; and 3) a target ring support assembly.

The main target ring member includes two primary components being 1) a ring opening section that has a target opening within a support wall portion; and 2) an indicia support or arrow shaped section integral with the support wall portion having target sequence indicia thereon.

The target net assembly includes two embodiments being either an open end net assembly or a closed end net assembly to receive a propelled golf ball therein from either opposing side of the ring opening section. The open end net assembly and the closed net assembly each include a plurality of spaced openings in a net body section attached to a main target ring member by means of a net anchor section. The net body section has an outer end which terminates either as 1) a closed end section in the closed end net assembly that prevents passage of a golf ball therethrough; or 2) an open end section in the open end net assembly that allows a golf ball to transverse the respective net body section and drop to the playing surface.

The target ring support assembly can be constructed either as a main ground support assembly which is of an integral construction or as a detachable ground anchor assembly. The main ground support assembly includes a handle and impalement section which is integral with the support wall section of the main target ring member. The handle and impalement section is integral with a fluked spike section which extends downwardly into a tapered end section terminating in a pointed end portion. The fluked spike section is formed with radially extended blade portions as noted in a transverse cross sectional view which prevents the game target ring assembly from twisting when inserted into a ground or game playing surface.

The detachable ground anchor section provides enhanced game setup flexibility through two primary components being 1) a target ring connector member integral with the main target ring member; and 2) a handle and impalement member to releasably receive and support the target ring connector member thereon.

The target ring connector member is of circular shape in transverse cross section operable to be inserted into a slightly larger hole in the handle and impalement member.

The handle and impalement member includes an arcuate grasp section integral with a fluked spike section having an outer tapered end section. The arcuate grasp section has a central target connector slot to receive a portion of the support wall portion of the main target ring member therein when in an assembled condition.

The fluked spike section is formed with radially extended blade portions as noted in a transverse cross sectional view which prevents the game target ring assembly from twisting when inserted into the game playing surface. Further, the fluked spike section is formed with a central target connector opening to releasably receive the target ring connector member when in the assembled condition.

OBJECTS OF THE INVENTION

One object of this invention is to provide a game target apparatus assembly that can be easily used in various areas such as lawns, hillsides, playgrounds, sandy beaches, and other suitable playing surfaces.

One other object of this invention is to provide a game target apparatus assembly that is simple in construction and usage having potential for challenging a participant's proficiency in a method of game play.

Another object of this invention is to provide a game target apparatus assembly that is readily portable and easily assembled on a game playing surface.

Still, another object of this invention is to provide a game target apparatus assembly that has multiple game target ring assemblies arranged in a multiple variety of game play configurations.

A further object of this invention is to provide a game target apparatus assembly having target sequence indicia to achieve a method of game playing similar to a game of golf that can be played by any number of participants.

One further object of this invention is to provide a game target apparatus assembly that provides a target net assembly providing a visual indication that the golf ball has transversed a target opening in a main target ring member.

Another further object of this invention is to provide a game target apparatus assembly having a closed end net assembly operable to receive and retain a golf ball propelled through the target opening in the target ring member and selectively operable to move the net assembly to an opposite side of the target ring member.

Another object of this invention is to provide a game target apparatus assembly including a game target ring assembly having a main target ring member which can be removed from a detachable ground anchor assembly allowing a small portion of the game to remain obtrusive when the game is not in use and the detachable ground anchor assembly is easily inserted into the game playing surface.

Still, one further object of this invention is to provide a game target apparatus assembly that is easily and comfortably impaled into a suitable game playing surface; economical to manufacture; challenging in a method of game play; and substantially maintenance free.

Various other objects, advantages, and features of the invention will become apparent to those skilled in the art from the following discussion, taken in conjunction with the accompanying drawings, in which:

FIGURES OF THE INVENTION

Figure 1:
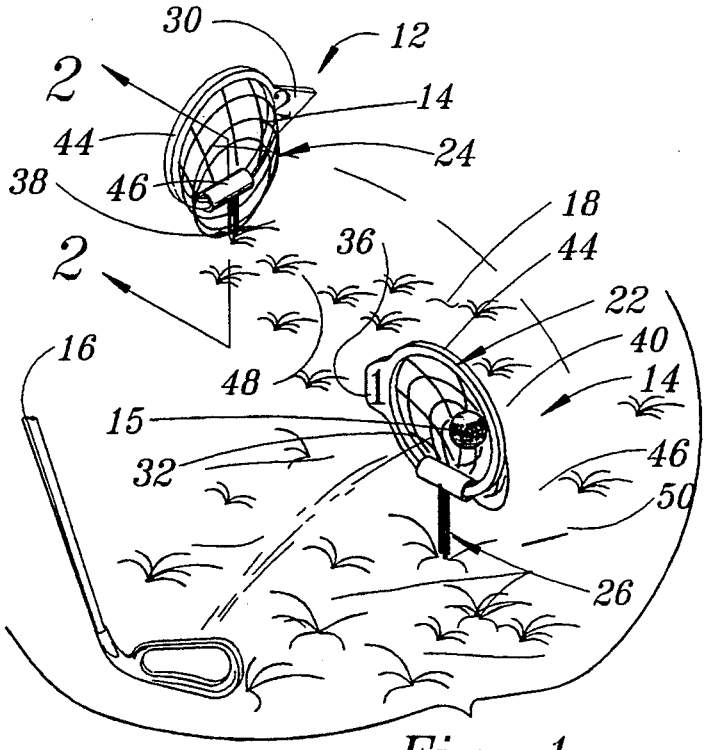
FIG. 1 is a perspective view of a game target apparatus assembly of this invention placed on a suitable game playing surface configured for use in a method of game play.

The following is a discussion and description of preferred specific embodiments of the game target apparatus assembly of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

Referring to the drawings in detail, and in particular to FIG. 1, a game target apparatus assembly of this invention, indicated generally at 12, would be configured on a suitable game playing surface 18. The game target apparatus assembly 12 includes a plurality of game target ring assemblies 14 which would be impaled in the game playing surface 18 providing a target opening to receive a golf ball 15 therethrough which is to be struck and propelled by a golf club 16.

Each game target ring assembly 14 includes 1) a main target ring member 22; 2) a target net assembly 24 attached to a perimeter of the main target ring member 22; and 3) a target ring support assembly 26 connected to the main target ring member 22.

The main target ring member 22 includes 1) a generally circular ring opening section 28; and 2) an arrow or oval shaped indicia support section 30 which is integrally molded in a lateral exterior edge of the main target ring member 22. Affixed to the arrow or oval shaped support section 30 is a target sequence indicia 36 being identical on each side of the arrow or oval shaped support section 30. The arrow or oval shaped support section 30 points toward the next game target ring assembly 14 to approach during a method of game play. The ring opening section 28 includes a support wall portion 34 which encircles a target opening 32. The support wall portion 34 is of rectangular shape in transverse cross section.

The target net assembly 24, when hit by a golf ball 15, indicates a successful attempt to pass the golf ball 15 through the target opening 32 in the ring opening section 28 of the main target ring member 22. The target net assembly 24 includes either of two embodiments being 1) an open end net assembly 38; or 2) a closed end net assembly 40. The open end net assembly 38 IS attached to the support wall portion 34 through a net anchor section 44.

The open end net assembly 38 includes a net body section 46 having a plurality of spaced openings 42 constructed to prevent a golf ball 15 from passing through the respective net openings 42. The open end net assembly 38 forms a generally cylindrical net terminating in an open end section 48 allowing the golf ball 15 to pass through the target net assembly 24 and return to the game playing surface 18.

The closed end net assembly 40 has a net anchor section 44 and a net body section 46 similar to the open end net assembly 38 but differs at a terminal end. The terminal end is formed with a closed end section 50 to capture the golf ball 15 to prevent it from returning to the game playing surface 18.

Each net assembly 38, 40 is constructed so as to flip-flop from one side to another side of the main target ring member 22 during the method of game play as will be described.

Figure 2:
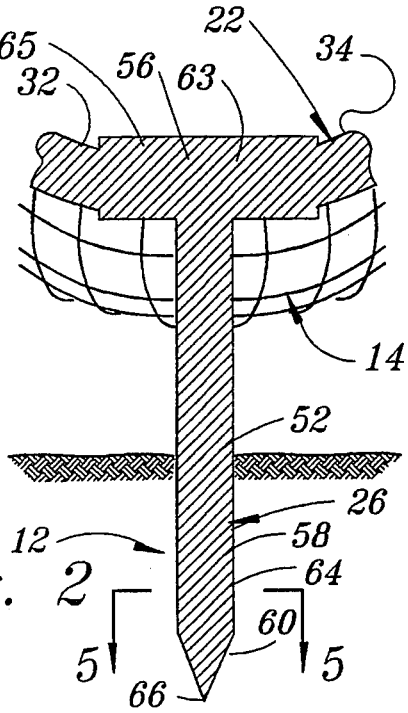
FIG. 2 is an enlarged fragmentary cross sectional view taken along line 2—2 in FIG. 1.

The target ring support assembly 26 has two embodiments being either 1) a main ground support assembly 52; or 2) a detachable ground anchor section 54. The main ground support assembly 52 is integrally molded to the main target ring assembly 22 as shown in FIG. 2.

The main ground support assembly 52 includes 1) a handle and impalement section 56; 2) an anchor or fluked spike section 58 integral with the handle and impalement section 56; and 3) a tapered end section 60 integral with an outer end of the fluked spike section 58.

The handle and impalement section 56 includes an arcuate or laterally extended grasp portion 63 which is oval shape in transverse cross section. The arcuate grasp portion 63 is formed with outer concave walls 65 to add strength and operable to receive a person's fist thereabout for ease of inserting the target ring support assembly 26 into the game playing surface 18 as will be described. The arcuate grasp portion 63 extends upwardly, outwardly, and downwardly of the support wall portion 34 being readily grasped by the person's fist and positioned centrally of the laterally extended fluked spike section 58. This allows considerable perpendicular force to be applied to the fluked spike section 58 for driving into the game playing surface 18. Similarly, the arcuate grasp portion 63 allows for easy removal of the fluked spike section 58 from the game playing surface 18.

Figure 5:
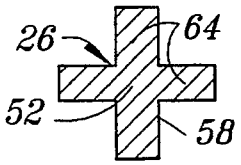
FIG. 5 is an enlarged sectional view taken along line 5—5 in FIG. 2.

As shown in FIG. 5, the fluked spike section 58 has four radial blade sections 64 extended substantially its entire length. For ease of ground penetration, the tapered end section 60 terminates in an end point portion 66.

Figure 3:
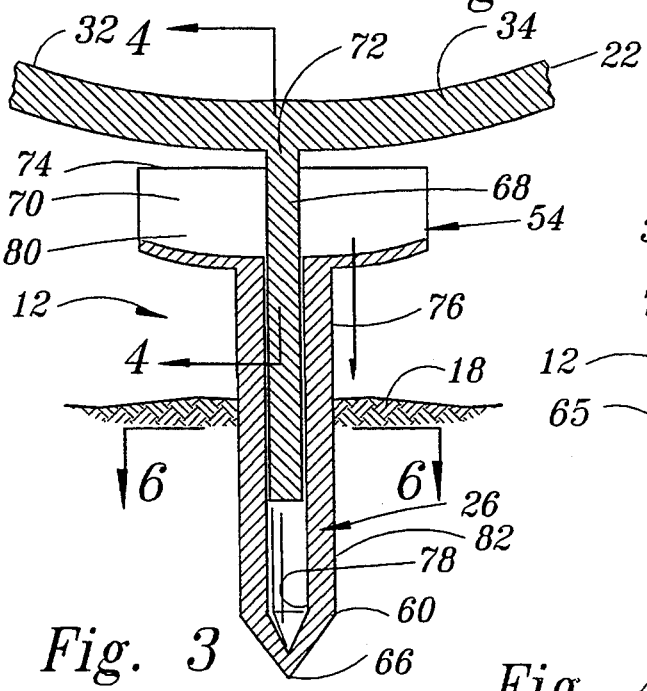
FIG. 3 is an enlarged fragmentary cross sectional view similar to FIG. 2 displaying a detachable ground anchor section of a target ring support assembly in a second embodiment of this invention.

Alternatively, the main target ring member 22 can be releasably supported on the detachable ground anchor section 54 as shown in FIG. 3.

The detachable ground anchor section 54 includes 1) a target ring connector member 68; and 2) a handle and impalement member 70 to releasably receive the target ring connector member 68 thereon. The target ring connector member 68, a circular rod-like protrusion, is preferably integrally molded to the main target ring member 22. A point of connection 72 forms a generally T-shaped union.

Figure 4:
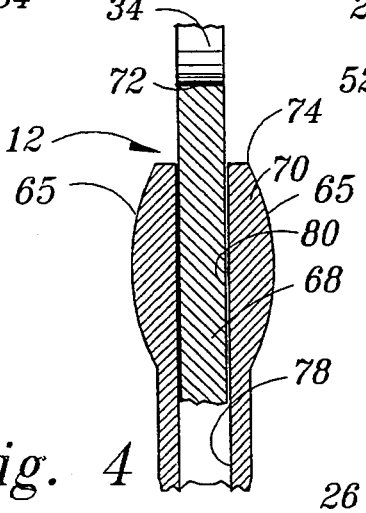
FIG. 4 is an enlarged fragmentary sectional view taken along line 4—4 in FIG. 3.

The handle and impalement member 70 is comprised of two primary components being 1) an arcuate grasp section 74; and 2) an anchor or fluked spike section 76 integrally molded with the arcuate grasp section 74 having a tapered end section 60 at an outer end thereof. As shown in FIGS. 3 and 4, the arcuate grasp section 74 is designed to allow the handle and impalement member 70 to be comfortably impaled in and removed from the game playing surface 18. More particularly, the arcuate grasp section 74 is formed with the outer concave walls 65 to add strength and operable to receive the person's fist thereabout for ease of inserting the detachable ground anchor assembly 54 into the game playing surface 18 in a manner to be described. The arcuate grasp section 74 extends upwardly, outwardly, and downwardly from the support wall portion 34 being readily grasped by the person's fist and positioned centrally of the laterally extended fluked spike section 76.

As noted in FIGS. 3 and 4, longitudinally formed in the arcuate grasp section 74 is a target selector slot 80 to receive and prevent rotation of the main target ring member 22 when it has been inserted into the handle and impalement member 70 as will be noted.

Figure 6:
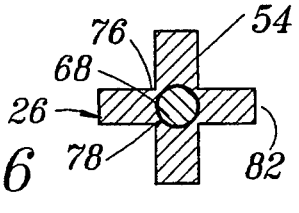
FIG. 6 is an enlarged sectional view taken along line 6—6 in FIG. 3.

The fluked spike section 76 is generally similar in construction to the fluked spike section 58 of the main ground support assembly 52 differing only in having a central target connector opening 78 and radially extended blade portions 82. The shaft of the fluked spike section 76, as shown in FIG. 6, has the target connector opening 78 which accepts the target ring connector member 68 therein. The fluked spike section 76 is integral with a tapered end section 60 terminating in an end point section 66 to facilitate penetration when inserted into the game playing surface 18.

USE AND OPERATION OF THE INVENTION

In the use and operation of the game target apparatus assembly 12 of this invention, one or more of the game target ring assemblies 14 are configured on the playing surface 18 as noted in FIG. 1.

To insert the individual game target ring assembly 14 into the playing surface 18, one of two methods are deployed depending on whether the detachable ground anchor assembly 54 or the main ground support assembly 52 is used. It should be noted that the game target apparatus assembly 12 with its method of game play is unaffected by the choice of which embodiment of the target ring support assembly 26 is used.

To impale the main ground support assembly 52 of the target ring support assembly 26 embodiment, the participant would grasp the arcuate grasp section 63 allowing the fluked spike section 58 to pass downwardly between the participant's fingers while forming a fist around the handle and impalement section 56. The participant would firmly push the main ground anchor assembly 52 into the playing surface 18 with the fluked spike section 58 being perpendicular thereto. The tapered end section 60 with the end point section 66 will ease the effort necessary to secure the game target ring assembly 14 in the game playing surface 18.

When installing the detachable ground anchor section 54 in the playing surface 18, the participant would grasp the handle and impalement member 70 while forming a fist around the arcuate grasp section 74 allowing the fluked spike section 76 to pass through the participant's fingers. The participant would then push the detachable ground anchor section 54 into the playing surface 18. The tapered end section 60 and end point section 66 will facilitate penetration. Once the detachable ground anchor section 54 has been secured, the main target ring member 22 and integral target ring connector member 68 are connected thereto by sliding the target ring connector member 68 into the target connector opening 78. The support wall portion 34 of the main target ring member 22 can then be oriented by rotation and placed in the target connector opening 78.

The placement of successive game target ring assemblies 14 should be indicated by orienting the arrow or oval shaped section 30 pointing towards the next sequential game target ring assembly 14. The target sequence indicia 36 should suggest a methodical progression to the next game target ring assembly 14 such as indicia "1" on the arrow or oval shaped section 30 pointing toward a game target ring assembly 14 having indicia "2" thereon, indicia "2" on the arrow or oval shaped section 30 pointing toward a game target ring assembly 14 having indicia "3" thereon, etc.

In the method of game play, the golf ball 15 is positioned at a common starting point or area on the playing surface 18 in a manner that the first target indicated by the target sequence indicia 36 is the first logical game target ring assembly 14. A participant, using a golf club 16, would strike the golf ball 15 in the general direction of the main target ring member 22 of the subject game target ring assembly 14. If the participant successfully hits the golf ball 15 into the target net assembly 24, the golf ball 15 will strike the net body section 46 indicating a successful shot. The golf ball 15 will then fall through the open end section 40 if equipped with an open end net assembly 38. If the target net assembly 24 is equipped with a closed end net assembly 40, the golf ball 15 will be contained in the closed end section 50 and the participant would manually remove the golf ball 15 to place on the playing surface 18. In either embodiment, the participant will hit the golf ball 15 into the target net assembly 24 before proceeding to the next sequential game target ring assembly 14.

A lower portion of each net body section 46 of the respective net assemblies 38, 40 extends below each respective handle and impalement section or member 56, 70 a distance slightly greater than a diameter of the object or golf ball being propelled (FIG. 2).

The size relationship of the object being propelled to the lower portion of each net body section 46 allows a flip-flop movement thereof. More particularly, when the golf ball 14 is propelled into the net assembly 40 as shown in FIG. 1, the golf ball 14 will fall downwardly and be retained therein by the lower portion.

When the golf ball 14 is propelled into the net assembly 40 from a direction opposite that shown in FIG. 1, the entire net body section 48 will move through the target opening 32. The golf ball 14 will fall downwardly and be retained therein by the lower portion of the net body section 46.

This flip-flop action applies to both net assemblies 38, 40 and allows a game participant to propel the golf ball 14 through the target opening 32 from either side of the target ring member 22. This flip-flop movement of the net body section 46 is important in the method of game play as a visual indicator that the golf ball 14 has traversed a respective target opening 32.

The method of game play progresses with participants alternating strokes until all participants successfully transverse each game target ring assembly 14 in the game target apparatus assembly 12. As in the game of golf, the participant with the minimum amount of total strokes utilized in the method of game play will be declared the winner.

When the game is finished, each game target ring assembly 14 can be removed and stored on grasping the handle and impalement section 56 or handle and impalement member 70. In the case of the detachable ground anchor section 54, only the main target ring member 22 with attached target ring connector member 68 need be removed. The handle and impalement member 70 can be left in the playing surface 18 so that an identical game target apparatus assembly 12 with its method of game play can be utilized with minimal surface intrusion.

The game target apparatus assembly of this invention is easy to play on a multiple surfaces such as a lawn, park, sandy beach, etc.; easy to install, requiring only slight pressure to impale into a playing surface; economical to manufacture; and substantially maintenance free.

While the invention has been described in conjunction with preferred specific embodiments thereof, it will be understood this description is intended to illustrate and not to limit the scope of the invention, which is defined by the following claims:

I claim:

1. A game target ring assembly operable to be utilized on a game playing surface by a game participant, comprising:

a) a main target ring member releasably connected to a detachable ground anchor assembly;

b) said main target ring member includes a ring opening section having a target opening therein defined as between a support wall portion, and a target ring connector member is secured to, and extended laterally of, said support wall portion;

c) said detachable ground anchor assembly having a handle and impalement member connected to an anchor section adapted to be inserted into the playing surface;

d) said handle and impalement member includes a grasp portion extended laterally of said anchor section;

e) said grasp portion includes a target connector slot operable to receive and enclose a portion of said target ring connector member and said support wall portion when in an assembled condition;

f) said anchor section having a target connector opening therein to releasably receive said target ring connector member therein when in the assembled condition; and g) said target connector slot of a width to prevent rotation of said support wall portion and said target ring connector member when said target ring connector member is mounted in said target connector opening;

whereby said grasp portion can be readily grasped by a fist of the game participant for ease of inserting said anchor section into the game playing surface.

* * * * *